US006230502B1

(12) United States Patent
Kershaw

(10) Patent No.: US 6,230,502 B1
(45) Date of Patent: May 15, 2001

(54) SUSPENSION SYSTEMS

(75) Inventor: Edward Wedderburn Kershaw, Oxon (GB)

(73) Assignee: Oxford Magnet Technology Limited, Oxford (GB)

( * ) Notice: Subject to any disclaimer, the term of this patent is extended or adjusted under 35 U.S.C. 154(b) by 0 days.

(21) Appl. No.: 09/484,012

(22) Filed: Jan. 18, 2000

(30) Foreign Application Priority Data

Jan. 16, 1999 (GB) ..... 9900845

(51) Int. Cl.[7] ..... F25B 19/00; A47H 1/10

(52) U.S. Cl. ..... 62/51.1; 62/297; 248/324; 248/317

(58) Field of Search ..... 62/51.1, 297; 248/317, 248/323, 324, 58

(56) References Cited

U.S. PATENT DOCUMENTS

| | | | | |
|---|---|---|---|---|
| 2,870,985 | * | 1/1959 | Martin et al. | 248/324 |
| 2,889,128 | * | 6/1959 | Martin et al. | 248/324 |
| 4,325,530 | * | 4/1982 | Niemann et al. | 248/317 |
| 4,721,934 | | 1/1988 | Stacy . | |
| 4,781,034 | * | 11/1988 | Nicol et al. | 62/51.1 |
| 4,838,033 | * | 6/1989 | Yamamoto et al. | 62/45.1 |
| 4,878,351 | | 11/1989 | Weber et al. . | |
| 5,034,713 | * | 7/1991 | Herd et al. | 335/216 |
| 5,139,223 | * | 8/1992 | Sedighzadeh | 248/324 |
| 5,140,823 | * | 8/1992 | Mraz | 62/51.1 |
| 6,042,068 | * | 3/2000 | Tcherny | 248/221.11 |

FOREIGN PATENT DOCUMENTS 1 266 873 3/1972 (GB) .

* cited by examiner

*Primary Examiner*—William Doerrler
(74) *Attorney, Agent, or Firm*—Evenson, McKeown, Edwards & Lenahan, P.L.L.C.

(57) ABSTRACT

Described herein is an improved suspension system for cryostat vessels forming a part of magnetic resonance imaging (MRI) apparatus. The MRI apparatus comprises an outer cylindrical element, an inner cylindrical element mounted within the outer element, and a suspension system for accurately mounting the inner element with respect to the outer element. The suspension system comprises a plate (40) pivotally mounted on the inner cylindrical element (10) for rotation relative thereto and a pair of continuous bands (66, 68) connecting the plate (40) to the outer element. Adjusters are positioned offset from the axis of rotation of the plate for tensioning the bands. Locking means are also provided to retain the plate in a given position relative to the outer element.

12 Claims, 2 Drawing Sheets

SUSPENSION SYSTEMS

Figure 1:
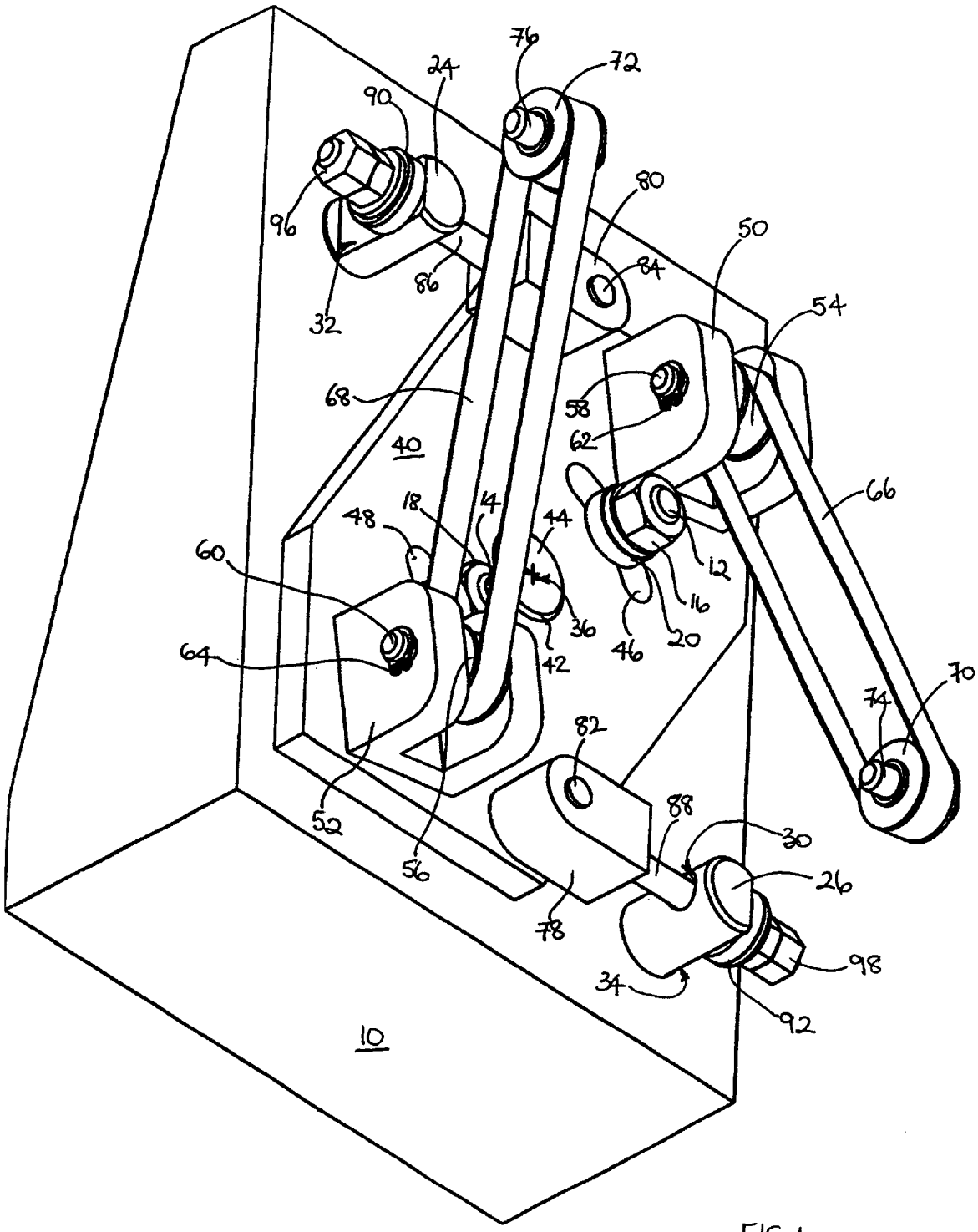

The present invention relates to improvements in or relating to suspension systems, and is more particularly, although not exclusively, concerned with suspension systems for mounting vessels in cryogenic dewars such as superconducting magnet cryostats for magnetic resonance imaging (MRI) apparatus.

Cryostats for MRI apparatus generally comprise at least two cylindrical vessels, an inner vessel and an outer vessel. The inner vessel is mounted within the outer vessel and is spaced apart from it. The inner vessel is generally known as a 'cold' vessel and the outer vessel as a 'warm' vessel. The annular space between the two vessels comprises a vacuum chamber to prevent convective heat transfer between the 'warm' vessel and the 'cold' vessel. The inner vessel is often suspended within the outer vessel by means of tensile members which have a high aspect ratio to minimise conductive thermal losses.

A particularly efficient type of tensile member comprises a composite fibre reinforced strap which has a 'race track' profile, the tensile strength of the member being provided by the continuously wound fibres. Such a strap is normally adjusted and pre-tensioned by pinning it at one end and connecting it to a threaded clevis at the other end. The threaded clevis projects from the end of the strap in the same plane as the strap and extra space within the vacuum chamber may be required to accommodate such an adjusting device.

When space in the vacuum chamber is of a premium along the longitudinal axis of the strap, it may not be feasible to fit a clevis to the end of the strap.

It is therefore an object of the present invention to provide an improved suspension system.

In accordance with one aspect of the present invention, there is provided a suspension system for connecting a first element to a second element, the system comprising: a tensile member for connecting the first element to the second element; first connecting means for connecting the tensile element to the first element; second connecting means for connecting the tensile element to the second element; and adjusting means for adjusting the tensile element to correctly position the second element with respect to the first element; characterised in that the adjusting means comprises a plate member having a pivot point about which it is rotatable, the plate member being pivotally mounted on the first element at the pivot point and connected to one end of the tensile member; and an adjusting member connected to the plate member for rotating the plate member about the pivot point to effect adjustment of the tensile element.

Advantageously, the adjusting member comprises a threaded push rod, one end of thereof being attached to the plate member at a point offset from the pivot point. The threaded push rod may be pivotally attached to the plate member.

Preferably, the threaded push rod is supported by a block member mounted on the first element and carries a nut arrangement at the end remote from the plate member, the nut arrangement bearing against the block member to effect rotation of the plate member as it is turned relative to the threaded push rod.

It is preferred that the tensile member comprises a continuous band. The band passes over a first bearing member mountable on the plate member and over a second bearing member mountable on the second element.

The apparatus in accordance with the present invention further comprises locking means for locking the position of the plate member with respect to the first element.

In accordance with a second aspect of the present invention, there is provided a cryostat system comprising: an outer cylindrical vessel; an inner cylindrical vessel; and at least one suspension system as described above; wherein the outer and inner cylindrical vessels comprise the first and second elements of the suspension system.

Figure 2:
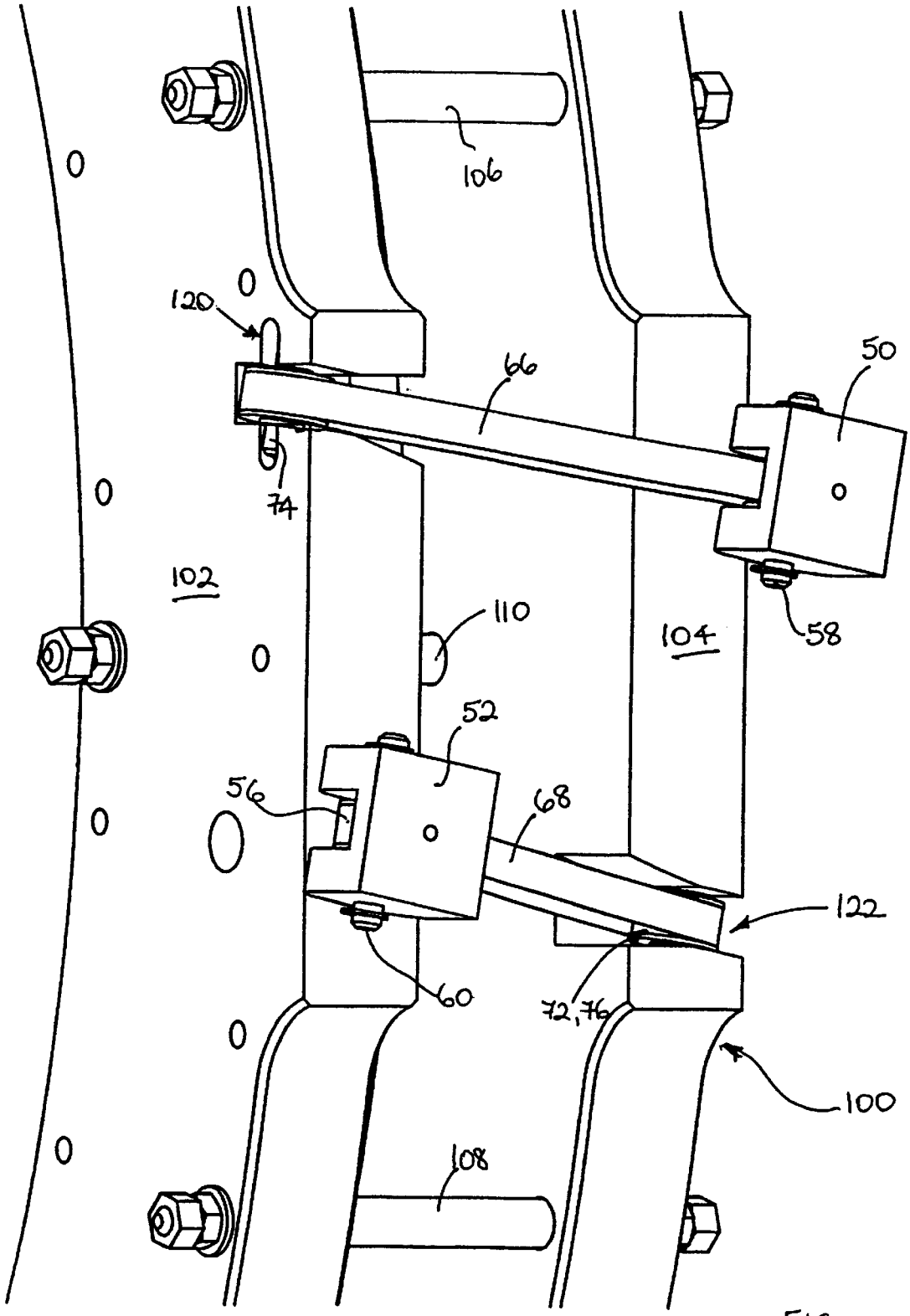

For a better understanding of the present invention, reference will now be made, by way of example only, to the accompanying drawings in which:

FIG. 1 is an isometric view of a portion of a 'warm' vessel of MRI apparatus illustrating a suspension system in accordance with the present invention; and FIG. 2 is an isometric view of a portion of a 'cold' vessel of MRI apparatus illustrating the location of the suspension system therein;

The present invention will be described with reference to a suspension system for cryostat vessels in MRI apparatus, but it will be readily appreciated that such a suspension system can readily be adapted for use in any environment where one member needs to be accurately positioned with respect to another member.

Referring initially to FIG. 1, a wall portion 10 of a 'warm' vessel of MRI apparatus is shown. It will be appreciated that the wall portion 10 is only shown as a block by way of example and in MRI apparatus the wall portion forms part of a continuous cylindrical vessel wall. The wall portion 10 has a pair of bolt portions, shown generally as 12, 14, attached thereto. As shown, each bolt portion 12, 14 has associated with it a nut 16, 18 and a washer 20, 22 (only washer 20 being visible). Each bolt portion 12, 14 is threaded at its end to accommodate the nuts 16, 18 and washers 20, 22. The wall portion 10 also has attached to it mounting blocks 24, 26 each of which has a through-hole 28, 30 formed therein (only through-hole 30 being visible). The mounting blocks 24, 26 are generally cylindrical, but at one end of each through-hole 28, 30, a flat bearing surface 32, 34 is provided. An aperture (not shown) is located between the two bolt portions 12, 14 for providing a pivot position 36 as will be discussed later.

Mounted on the wall portion 10 is a mounting plate 40. The mounting plate 40 is generally rectangular with a pair of opposite corners removed. However, it will be appreciated that the mounting plate can have any other suitable shape, for example, a circle. The mounting plate 40 has an aperture 42 formed substantially at its centre along the diagonal extending between the two remaining corners of the rectangle. A pivot pin 44 is used to rotatably attach the mounting plate 40 to the wall portion 10, the pivot pin 44 passing through aperture 42 and into the aperture in the wall portion 10 to define the pivot position 36. The mounting plate 40 also has two arcuate apertures 46, 48 formed in it along the diagonal, the apertures 46, 48 being diametrically disposed about central aperture 42. The arcuate apertures 46, 48 receive bolt portions 12, 14 when the mounting plate 40 is assembled on the wall portion 10. As the mounting plate 40 is rotated about the pivot position 36, the bolt portions 12, 14 move within their respective apertures 46, 48. This will be described in more detail later.

Mounting plate 40 also has bearing blocks 50, 52 attached to it. Bearing blocks 50, 52 house respective rotatable bearing members 54, 56 mounted on respective shafts 58, 60 which extend through the bearing blocks as shown. Each shaft 58, 60 is retained in its associated bearing block 50, 52 by means of circlips 62, 64. It will readily be appreciated that any other suitable means can be used for retaining the shafts 58, 60 in the bearing blocks 50, 52.

Prior to assembly in their respective bearing blocks 50, 52, each rotatable bearing member 54, 56 is passed through a tensile band 66, 68 so that once assembled, the tensile bands 66, 68 are retained within the bearing blocks 50, 52 as shown. Each tensile band 66, 68 forms a continuous loop and is carried by respective rotatable bearing members 54, 56 at one end of the loop and a further rotatable bearing member 70, 72 at the other end of the loop. Rotatable bearing members 70, 72 are mounted on respective shafts 74, 76 which engage with slots 120, 122 (shown in FIG. 2) formed in annular plates 102, 104 (shown in FIG. 2) of a 'cold' vessel of the MRI apparatus.

Mounting plate 40 also supports tensioning blocks 78, 80. Each tensioning block 78, 80 is pivotally mounted on the plate 40 by means of respective pivot pins 82, 84. As shown, the tensioning blocks 78, 80 are elongate in shape and the pivot pins 82, 84 are located at one end thereof. Attached to the other ends of the tensioning blocks 78, 80 are respective push-rods 86, 88 which are threaded along at least a part of their length extending from their ends remote from the tensioning blocks 78, 80. Naturally, it will be appreciated that the push-rods 86, 88 can be threaded along their entire lengths. As shown, each push-rod 86, 88, when assembled, passes through a respective one of the through-holes 28, 30 (only hole 30 being visible) in mounting blocks 24, 26, and carries respective washers 90, 92 and nuts 96, 98.

FIG. 2 illustrates a portion 100 of the 'cold' vessel which comprises two annular end plates 102, 104 which carry an annular superconducting electromagnet (not shown) between them. The two end plates 102, 104 are bolted together around their periphery by bolts 106, 108, 110. Naturally, other bolts will also be provided around the remaining periphery for securing the two end plates together. As shown, end plates 102, 104 have respective shaped slots 120, 122 formed in them. Mounting plate 40 and the wall portion 10 of the 'warm' vessel are not shown for clarity.

In accordance with the present invention, in order to mount a 'cold' vessel of which wall portion 100 forms a part within a 'warm' vessel of which portion 10 forms a part, a plurality of suspension systems are attached to the 'warm' vessel and then connected to the 'cold' vessel. However, for simplicity, the attachment and connection of one suspension system will be described.

Mounting plate 40 carrying the assembled bearing blocks 50, 52, 54, 56, 58, 60 and tensile bands 66, 68 is attached to the 'warm' vessel with arcuate slots 46, 48 receiving respective bolt portions 12, 14 and pivot pin 42 passing through central aperture 42 and into a hole formed in the vessel. Nuts 16, 18 and washers 20, 22 are placed on respective ones of the bolt portions 12, 14 but are not tightened as to prevent movement of the mounting plate 40 relative to the vessel. Bearing members 70, 72 assembled on their shafts 74, 76 are introduced into the other ends of the bands 66, 68 and then, when the 'cold' vessel is positioned inside the 'warm' vessel, the bearing members 70, 72 and their shafts 74, 76 are clipped into respective ones of the slots 120, 122 provided in the 'cold' vessel. The tensile bands 66, 68 are then adjusted to retain the bearing members 70, 72 and their shafts 74, 76 in the slots 120, 122. It is to be noted that although each tensile band is shown as being attached to a different end plate to the other tensile band, both bands could be attached to the same end plate.

Adjustment of the tensile bands 66, 68 will now be described more fully with further reference to FIG. 1. Nuts 16, 18 on bolt portions 12, 14 are initially loose when the mounting plate 40 is attached to the 'warm' vessel as stated above, that is, in an unlocked position. This allows the mounting plate 40 to rotate about the pivot position 36 with the bolt portions 12, 14 moving within the arcuate slots 46, 48 as described above. The mounting plate 40 is rotated about the pivot position 36 to extend the tensile bands 66, 68 by adjusting nuts 96, 98 on push-rods 86, 88 so that tensioning blocks 78, 80 are pulled towards their associated mounting blocks 24, 26, washers 90, 92 under respective nuts 96, 98 abutting against the flat bearing surfaces 32, 34 of the mounting blocks 24, 26. During adjustment, the mounting plate 40 rotates in an anti-clockwise direction, as viewed in FIG. 1, due to the moment applied as the nuts 96, 98 are tightened on push-rods 86, 88, the torque being applied to the plate being proportional to the tension in the push-rods. Once the tensile bands 66, 68 have been correctly tensioned, nuts 16, 18 on bolts 12, 14 are tightened to lock the plate 40 in position with respect to the 'warm' vessel.

It will readily be appreciated that the plane of the plate 40 is angled with respect to the tensile bands 66, 68. This means that further space in the axis of the tensile bands is not required for adjustment. Furthermore, if the bands are substantially still, only small angles of rotation are required to apply the required tension. Therefore, little space is required for the plate 40 to rotate. Moreover, there is no need to have accurately positioned suspension fittings within the 'warm' vessel as the pivot position about which the mounting plate rotates can be accurately provided by a simple drilling operation.

It will readily be appreciated that, although only one suspension system has been described and illustrated, more than one identical systems may be employed. For example, in MRI apparatus, it may be suitable to have three or more suspension systems as described above for maintaining accurate positioning of the 'warm' vessel with respect to the 'cold' vessel.

In the described embodiment of the suspension system, two tensile bands are used to provide the adjustment, but it will readily be appreciated that a single tensile band can also be used depending on the particular application of the suspension system.

Although rotation of the mounting plate 40 has been described as being achieved by adjustment of push-rods 86, 88, it will readily be understood that rotation may be applied directly to the plate by any other suitable means, for example, by means of a special tool or torque wrench.

What is claimed is:

1. A suspension system for connecting a first element to a second element, the system comprising:

a tensile member for connecting the first element to the second element;

first connecting means for connecting the tensile element to the first element;

second connecting means for connecting the tensile element to the second element; and adjusting means for adjusting the tensile element to correctly position the second element with respect to the first element;

characterised in that the adjusting means comprises a plate member having a pivot point about which it is rotatable, the plate member being pivotally mounted on the first element at the pivot point and connected to one end of the tensile member; and an adjusting member connected to the plate member for rotating the plate member about the pivot point to effect adjustment of the tensile element.

2. A system according to claim 1, wherein the adjusting member comprises a threaded push rod, one end of thereof being attached to the plate member at a point offset from the pivot point.

3. A system according to claim 2, wherein the threaded push rod is pivotally attached to the plate member.

4. A system according to claim 2, wherein the threaded push rod is supported by a block member mounted on the first element and carries a nut arrangement at the end remote from the plate member, the nut arrangement bearing against the block member to effect rotation of the plate member as it is turned relative to the threaded push rod.

5. A system according to claim 1, wherein the tensile member comprises a continuous band.

6. A system according to claim 5, wherein the band passes over a first bearing member mountable on the plate member and over a second bearing member mountable on the second element.

7. A system according to claim 6, wherein the first bearing member is mounted in a bearing block attached to the plate member.

8. A system according to claim 1, further including locking means for locking the position of the plate member with respect to the first element.

9. A cryostat system comprising:

an outer cylindrical vessel;

an inner cylindrical vessel; and at least one suspension system according to any one of the preceding claims; wherein the inner and outer cylindrical vessels comprise the first and second elements of the suspension system.

10. A cryostat system according to claim 9, wherein the inner cylindrical vessel comprises the first element.

11. A cryostat system according to claim 9, wherein the outer cylindrical vessel comprises the first element.

12. A cryostat system according to claim 9, comprising a plurality of suspension systems.

* * * * *